US012662915B2

(12) United States Patent
Iblings et al.

(10) Patent No.: US 12,662,915 B2
(45) Date of Patent: Jun. 23, 2026

(54) DISPOSABLE PERFORATION TOOL

(71) Applicant: Schlumberger Technology Corporation, Sugar Land, TX (US)

(72) Inventors: David Iblings, Rosharon, TX (US); Corey Lehman, Rosharon, TX (US); Xiao Xiao Zhang, Shanghai (CN); Ting Gao, Shanghai (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/141,060

(22) PCT Filed: Apr. 29, 2024

(86) PCT No.: PCT/US2024/026746
§ 371 (c)(1),
(2) Date: Jun. 19, 2025

(87) PCT Pub. No.: WO2024/227128
PCT Pub. Date: Oct. 31, 2024

(65) Prior Publication Data

US 2026/0043317 A1 Feb. 12, 2026

Related U.S. Application Data

(60) Provisional application No. 63/498,924, filed on Apr. 28, 2023.

(51) Int. Cl.
*E21B 43/117* (2006.01)
*E21B 43/1185* (2006.01)
*E21B 43/119* (2006.01)

(52) U.S. Cl.
CPC ..... *E21B 43/117* (2013.01); *E21B 43/1185* (2013.01); *E21B 43/119* (2013.01)

(58) Field of Classification Search
CPC ... E21B 43/117; E21B 43/1185; E21B 43/119
See application file for complete search history.

(56) References Cited

U.S. PATENT DOCUMENTS 7,278,491 B2 * 10/2007 Scott ..... E21B 43/119 166/380
11,732,556 B2 * 8/2023 Eitschberger ..... E21B 43/117 166/297

(Continued)

OTHER PUBLICATIONS

International Search Report and Written Opinion of International Patent Application No. PCT/US2024/026746 dated on Aug. 13, 2024, 11 pages.

*Primary Examiner* — D. Andrews
(74) *Attorney, Agent, or Firm* — Jeffrey D. Frantz

(57) ABSTRACT

A perforation tool is described herein which has a loading tube for supporting a plurality of perforation charges, the loading tube having a first end and a second end; a detonation module disposed within the loading tube and having a plastic detonator housing for enclosing a detonation component, the detonator housing having a plurality of first flexible projections that extend in an axial direction of the detonator housing and engage with the loading tube to removably attach the detonation module to the first end of the loading tube, the detonator housing having a first centering structure for centering the loading tube within the perforation tool; and a bulkhead module coupled to the second end of the loading tube, the bulkhead module comprising a bulkhead member and a bulkhead coupler, the bulkhead coupler comprising an electrical connector for making electrical connection with the bulkhead member and a plurality of second flexible projections that extend in an axial direction of the perforation tool and engage with the loading tube, along an outer surface thereof, to removably attach the bulkhead coupler to the loading tube.

15 Claims, 6 Drawing Sheets

(56) References Cited

U.S. PATENT DOCUMENTS

| | | | | |
|---|---|---|---|---|
| 12,241,341 | B2 | 3/2025 | Ghosh | |
| 2013/0014990 | A1 | 1/2013 | Barton | |
| 2020/0256166 | A1* | 8/2020 | Knight | F42D 1/05 |
| 2021/0355794 | A1 | 11/2021 | Sokolove | |
| 2022/0034206 | A1 | 2/2022 | Bradley | |
| 2022/0163298 | A1 | 5/2022 | Kash | |

* cited by examiner

100

DISPOSABLE PERFORATION TOOL

CROSS-REFERENCE TO RELATED APPLICATIONS

This patent application is a National Stage Entry of International Application No. PCT/US2024/026746, filed Apr. 29, 2024, which claims benefit of U.S. Provisional Patent Application Ser. No. 63/498,924 filed Apr. 28, 2023, which is entirely incorporated herein by reference.

BACKGROUND

This section provides background information to facilitate a better understanding of the various aspects of the disclosure. It should be understood that the statements in this section of this document are to be read in this light, and not as admission of prior art.

Hydrocarbon reservoirs are commonly stimulated to increase recovery of hydrocarbons. For example, hydraulic fracturing injects a fluid at a pressure above the fracture strength of the hydrocarbon reservoir in order to recover hydrocarbons from the hydrocarbon reservoir. In general, a well is drilled into a formation, and a casing is formed on the outer wall of the well. The casing is then perforated using explosives to form holes in the casing that can extend a certain distance into the formation from the outer wall of the well.

The tool used to perforate the casing and/or the well wall is an elongated structure that uses explosive charges shaped to direct a high-energy material discharge toward the casing and/or well wall to form an opening in the casing and a bore into the well wall. The perforation tool is typically transported to a well site and connected to a drill string, or other assembly such as tubing, wireline, coiled tubing, or slickline, to insert the tool into the well. The perforation tool may be shipped with explosive charges installed, or without explosive charges. A detonation module is used to activate the explosive charges. The detonation module is usually installed into the perforation tool at the well site. Thus, there is considerable assembly that must be performed at the well site to prepare a perforation tool for use. Moreover, a plurality of such tools may be assembled into one drill string. As such, there is a continual need for improved perforation tools that are easy to assemble into a working configuration for perforating the formation.

SUMMARY

Embodiments described herein provide a perforation tool, comprising a loading tube for supporting a plurality of perforation charges, the loading tube having a first end and a second end; a detonation module disposed within the loading tube at the first end thereof, the detonation module comprising a plastic detonator housing for enclosing a detonation component, the detonation component comprising an activator positioned along an axis of the detonator housing and a booster located at a discharge end of the detonator housing, the booster coupled to the activator to receive an energy stimulus from the activator, the detonator housing having a plurality of first flexible projections that extend in an axial direction of the detonator housing and engage with the loading tube, along an interior surface thereof, to removably attach the detonation module to the first end of the loading tube, the detonator housing having a first centering structure for centering the loading tube, at the first end thereof, within the perforation tool; and a bulkhead module coupled to the second end of the loading tube, the bulkhead module comprising a bulkhead member and a bulkhead coupler, the bulkhead coupler comprising an electrical connector for making electrical connection with the bulkhead member and a plurality of second flexible projections that extend in an axial direction of the perforation tool and engage with the loading tube, along an outer surface thereof, to removably attach the bulkhead coupler to the loading tube, the bulkhead coupler having a second centering structure for centering the loading tube, at the second end thereof, within the perforation tool.

Other embodiments described herein provide a perforation tool, comprising a loading tube for supporting a plurality of perforation charges, the loading tube having a first end and a second end; a detonation module disposed within the loading tube at the first end thereof, the detonation module comprising a plastic detonator housing for enclosing a detonation component, the detonation component comprising an activator positioned along an axis of the detonator housing and a booster located at a discharge end of the detonator housing, the booster coupled to the activator to receive an energy stimulus from the activator, the detonator housing having a plurality of first flexible projections that extend in an axial direction of the detonator housing and engage with the loading tube, along an interior surface thereof, to removably attach the detonation module to the first end of the loading tube, the detonator housing having a first centering structure for centering the loading tube, at the first end thereof, within the perforation tool and a cushion structure within the first centering structure; and a bulkhead module coupled to the second end of the loading tube, the bulkhead module comprising a bulkhead member and a bulkhead coupler, the bulkhead coupler comprising an electrical connector for making electrical connection with the bulkhead member and a plurality of second flexible projections that extend in an axial direction of the perforation tool and engage with the loading tube, along an outer surface thereof, to removably attach the bulkhead coupler to the loading tube, the bulkhead coupler having a second centering structure for centering the loading tube, at the second end thereof, within the perforation tool.

Other embodiments described herein provide a perforation tool, comprising a loading tube for supporting a plurality of perforation charges, the loading tube having a first end and a second end; a detonation module disposed within the loading tube at the first end thereof, the detonation module comprising a plastic detonator housing for enclosing a detonation component, the detonation component comprising an activator positioned along an axis of the detonator housing and a booster located at a discharge end of the detonator housing, the booster coupled to the activator to receive an energy stimulus from the activator, the detonator housing having a plurality of first flexible projections that extend in an axial direction of the detonator housing and engage with the loading tube, along an interior surface thereof, to removably attach the detonation module to the first end of the loading tube, the detonator housing having a first centering structure for centering the loading tube, at the first end thereof, within the perforation tool and a cushion structure within the first centering structure; and a bulkhead module coupled to the second end of the loading tube, the bulkhead module comprising a bulkhead member and a bulkhead coupler, the bulkhead coupler comprising an electrical connector for making electrical connection with the bulkhead member and a plurality of second flexible projections that extend in an axial direction of the perforation tool and engage with the loading tube, along an outer surface thereof, to removably attach the bulkhead coupler to the loading tube, the bulkhead coupler having a second centering structure for centering the loading tube, at the second end thereof, within the perforation tool, wherein the detonator housing further comprises a third centering structure for centering the detonator housing within the loading tube.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
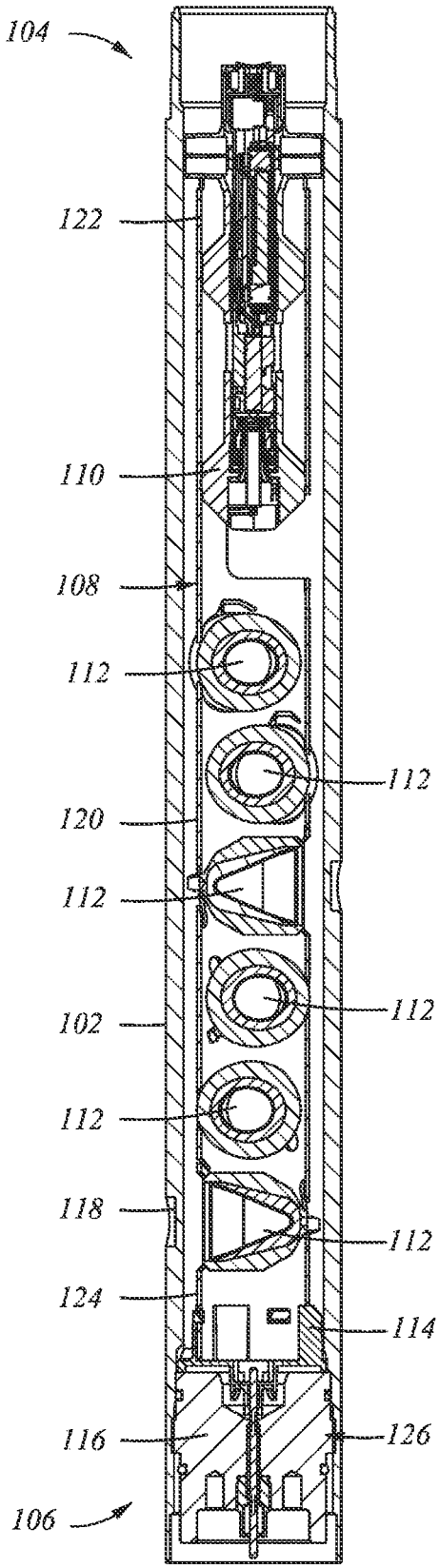
FIG. 1 is a cross-sectional view of a perforation tool, in accordance with an embodiment of the present disclosure.

In the following description, numerous details are set forth to provide an understanding of the present disclosure. However, it may be understood by those skilled in the art that the methods of the present disclosure may be practiced without these details and that numerous variations or modifications from the described embodiments may be possible.

At the outset, it should be noted that in the development of any such actual embodiment, numerous implementation-specific decisions are made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. The term about should be understood as any amount or range within 10% of the recited amount or range (for example, a range from about 1 to about 10 encompasses a range from 0.9 to 11). Also, in the summary and this detailed description, it should be understood that a concentration range listed or described as being useful, suitable, or the like, is intended that any concentration within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, even if specific data points within the range, or even no data points within the range, are explicitly identified or refer to a few specific, it is to be understood that inventors appreciate and understand that any data points within the range are to be considered to have been specified, and that inventors possessed knowledge of the entire range and the points within the range.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

As used herein, "embodiments" refers to non-limiting examples disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program comprises instructions causing the computer to execute one or more of the operations, or to issue commands to other devices to execute one or more of the operations.

As mentioned above, hydrocarbon reservoirs are commonly stimulated to increase recovery of hydrocarbons. For example, hydraulic fracturing injects a fluid at a pressure above the fracture strength of the hydrocarbon reservoir in order to recover hydrocarbons from the hydrocarbon reservoir. In general, a well is drilled into a formation, and a casing is formed on the outer wall of the well. The casing is then perforated using explosives to form holes in the casing that can extend a certain distance into the formation from the outer wall of the well.

Accordingly, the present disclosure describes various embodiments of a perforation tool (e.g., a perforation gun) that is configured to house a detonation module using disposable components. In particular, the perforation tool provides several advantages over conventional perforation tools. FIG. 1 is a cross-sectional view of a perforation tool 100 according to one embodiment. The perforation tool 100 has a metal housing 102 that generally houses the components of the tool. The metal housing 102 is generally cylindrical in topological form with a longitudinally extended body having a central axis. In most cases, the metal housing 102 is generally circular in profile, but other profile shapes can be used in certain cases. The perforation tool 100 generally has a detonator end 104 and a bulkhead end 106. The detonator end 104 is configured to allow installation of a charge module 108 that has a detonation module 110, a plurality of perforation charges 112 and a bulkhead coupler 114. The bulkhead end 106 is configured to receive a bulkhead member 116. The housing 102, in this case, has a plurality of openings 118 that register with the perforation charges 112 to allow an explosive discharge from each perforation charge 112 to pass through the metal housing 102, through the openings 118, into a formation below the surface of the earth. In other embodiments, the metal housing 102 can have thin wall portions instead of openings, where the thin wall portions are thin enough to be penetrated by the explosive discharge of the perforation charges 112.

The charge module 108 has a loading tube 120 that holds the perforation charges 112 in a central region thereof. The loading tube 120 is metal, for example steel, in this case, and has a first end 122 and a second end 124. When installed in the housing 102, the first end 122 is generally co-located with the detonator end 104 of the housing 102 and the second end is generally co-located with the bulkhead end 106. The detonation module 110 is disposed within the loading tube 120 at the first end 122 thereof. A bulkhead module 126 is coupled to the second end 124 of the loading tube 120. The bulkhead module 126 comprises the bulkhead member 116 and the bulkhead coupler 114. The detonation module 110 is inserted into the first end 122 of the loading tube 120 and attaches to the loading tube 120 upon insertion to a certain extent. The bulkhead member 116 makes electrical connection with the bulkhead coupler 114, which attaches to the second end 124 of the loading tube 120. The bulkhead member 116 engages with the metal housing 102 at the bulkhead end 106 thereof, for example by threaded connection.

Figure 2:
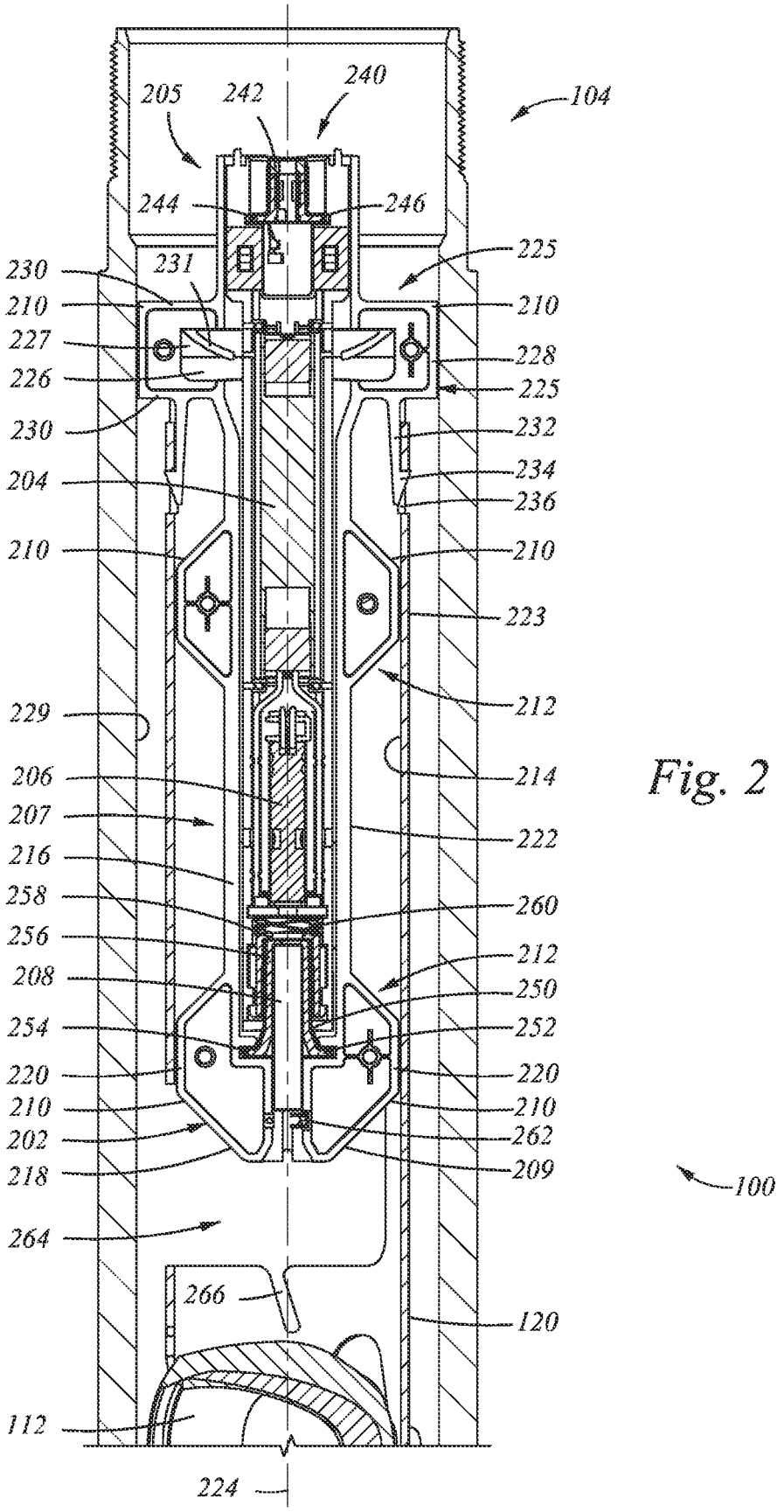
FIG. 2 is a detailed cross-sectional view of a portion of the perforation tool of FIG. 1.

FIG. 2 is a detailed cross-sectional view of the detonator end 104 of the perforation tool 100. The detonation module 110 has a detonator housing 202, which is plastic in this case, that houses a detonation component comprising a activator 204 at a stimulus end 205 of the detonator housing 202, a detonator 206 in a central region 207 of the detonator housing 202, and a booster 208 at a discharge end 209 of the detonator housing 202. The activator 204 is electrically coupled to the detonator 206, which is fluidly coupled to the booster 208. The activator 204 comprises circuitry for producing an electrical impulse to activate the detonator 206. The detonator 206 creates a discharge of ballistic energy that is received by the booster 208 due to fluid coupling with the detonator 206. The booster 208 is coupled with a ballistic transfer member (not shown), which can be a detonation cord, to carry ballistic energy to the charges 112. The detonator housing 202 positions the activator 204, detonator 206, and booster 208 in linear configuration along a central longitudinal axis 224 of the detonator housing 202, which is substantially the same, in this case, as a central axis of the perforation tool 100.

The detonation module 110 is received in the interior of the loading tube 120. The detonator housing 202 has a plurality of lateral stand offs 210 that function to position the detonation module 110 within the perforation tool 100. A first portion 212 of the lateral standoffs 210 contact the loading tube 120, at an inner surface 214 thereof, when the detonation module 110 is coupled to the loading tube 120. The standoffs 212 are generally trapezoidal in shape and project radially outward from a tube portion 216 of the detonator housing 202. Here, the standoffs 212 are distributed in groups along a longitudinal direction of the detonator housing 202, at different axial positions along the detonator housing 202, with the standoffs 212 in one group having the same axial position and different groups of the standoffs 212 having different axial positions, but in other cases, all the standoffs 212 could have the same axial position on the detonator housing 202, and in still other cases the standoffs 212 can be distributed individually, not in groups, with individual projections having different axial positions along the detonator housing 202.

Each of the first standoffs 212 has two angled parts 218 and a flat part 220, the angled parts 218, being substantially coplanar in a plane parallel to the axis 224 and extending radially outward from the tube portion 216. The angled parts 218 extend radially outward, along the plane of coplanarity, from an outer surface 222 of the tube portion 216 to the inner surface 214 of the loading tube 120, where the projection contacts the loading tube 120. The standoffs 212 are arranged in opposing positions around the tube portion 216 to provide a centering function for the detonation module 110. Centering the detonation module 110 optimizes ballistic and electrical continuity of the perforation tool 100. The standoffs 212 may also act to absorb shock energy in some cases, thus reducing the impact of shock energy on components, especially electrical components, of the detonation module 110. It should be noted that, here, the angled parts 218 of one standoff 212 extend toward each other, but in alternate embodiments the angled parts 218 could be parallel (i.e. the standoff could be rectangular rather than trapezoidal) or the angled parts 218 could extend away from each other. It should also be noted that, whereas here the standoffs 212 are solid tab-like structures, with material extending from the outer surface 222 of the tube portion 216 to the flat part 220, and from one angled part 218 to the other, the standoffs 212 could have openings between the angled parts 218 and between the tube portion 216 and the flat part 220 to provide selective flexibility of the projection of the first portion 212.

The standoffs 212 are also symmetrical, here, across a plane perpendicular to the axis 224 and across a plane parallel to the axis 224 (or including the axis 224). The angled parts 218 define equal angles with a line perpendicular to the axis 224. In other embodiments, the standoffs 212 can have any suitable shape, which can be regular or irregular in any reasonable respect. The symmetries evident in this case are optional and might not be found in other embodiments. For example, the angled parts 218 of one standoff might define different angles with a line perpendicular to the axis 224. The standoffs could be "swept" forward or backward along the detonator housing 202. In other cases, rather than getting narrower with distance from the tube portion 216 the standoffs might get wider with distance from the tube portion 216. In other cases, rather than the angled parts 218, the standoffs can have curved parts. It should also be noted that, where here the first standoffs 212 are all substantially the same shape, the first standoffs 212 could have different shapes, one from another.

A second portion 225 of the standoffs 210 extend radially outward from the tube portion 216 of the detonator housing 202. The second standoffs 225 extend beyond the loading tube 120 and contact the housing 102 at an inner surface 229 thereof. The second standoffs 225 thus extend further from the tube portion 216 than the first standoffs 212. The second standoffs 225 are located at the stimulus end 205 of the detonator housing 202 and extend radially outward beyond the radius of the loading tube 120 so the standoffs 225 can contact the inner surface 229 of the housing 102. As with the first standoffs 212, the second standoffs 225 are arranged in opposing positions around the tube portion 216 of the detonator housing 202. The standoffs 225 thus form a centering structure of the detonator housing 202.

The second standoffs 225 define an inner space 226 at the stimulus end 205 of the detonator housing 202. The material and construction of the second standoffs 225 can also provide a shock absorbance property at the stimulus end 205 of the housing in some cases to reduce the impact of ballistic energy on the detonator housing 202 and components, especially electrical components of the activator 204. Here, the standoffs 225 have a rectangular profile, with a flat portion 228 that contacts the inner surface 229 of the housing 102 and lateral portions 230 that connect the flat portion 228 to the tube portion 216 of the detonator housing 202.

The second standoffs 225 have a cushion structure 227 located in the inner space 226. The cushion structure 227, in this case, includes a plurality of fingers 231, each of which is elongated in a direction transverse to the axial direction of the perforation tool 100 and to the axis 224 of the detonator housing 202. The fingers 231 flex in a direction lateral to the direction in which the fingers extend to absorb mechanical stress imparted to the detonator housing 202 from ballistic discharge and other stresses. In this case, each finger 231 is attached to one of the second standoffs 225 and extends, within the inner space 226, radially inward and in an azimuthal direction.

Each of the second standoffs 225 has a projection 232, so the detonator housing 202 has a plurality of the projections 232, which extend in an axial direction of the detonator housing 202 from the respective standoff 225. The projections 232 are flexible, and in this case extend in the axial direction toward the discharge end 209 of the detonator housing 202 along the inner surface 214 of the loading tube 120 to engage the loading tube 120 along the inner surface 214 to removably attach the detonation module 110 to the first end 122 of the loading tube. In other cases, the projections 232 could extend toward the stimulus end 205 of the detonator housing 202 with appropriate loading tube configuration. The flexible projections 232 can have a catch 234 at the end, such as a hook, to engage with an opening 236 of the loading tube 120 and removably attach the detonation module 110 to the loading tube 120 at the first end 122 thereof. The catches 234, in this case, engage with the openings 236 of the loading tube 120 in an outward radial direction. In other cases, the projections 232 could extend along an outer surface 223 of the loading tube, and the catches 234 can engage with the openings 236 in an inward radial direction. The flexibility of the projections 232 enables the catches 234 to be disengaged from the openings 236 so the detonation module 110 can be removed from the loading tube 120. The projections 232 provide frictional engagement with the loading tube 120 to simplify insertion and retention, and the catches 234 provide additional optional secure attachment to the loading tube 120.

The detonation module 110 includes an electrical coupling 240 at the stimulus end 205 thereof to receive an electrical supply for powering the circuitry of the activator 204 and supplying electrical energy to activate the detonator 206. The electrical coupling 240 includes a connector 242 that has a flange 244, which is captured in a circumferential capture recess 246 at the stimulus end 205 of the detonator housing 202. Wiring, or other electrical conduit structure, electrically couples the connector 242 to the activator 204. In addition to providing electric power for the activator 204, the electrical coupling 240 also supports electrical continuity of the perforation tool 100 to provide electric power to adjacent tools.

At the discharge end 209 of the detonator housing 202, the booster 208 is housed in a receptacle 250 that also has a flange 252, which is captured in a circumferential groove 254 at the discharge end 209 of the detonator housing 202. The receptacle has a nose 256 with an opening 258 to allow fluid communication between the booster 208 and the interior of the detonation module 110, and specifically between the booster 208 and the detonator 206. Disposed between the detonator 206 and the booster 208 is a compressible annular electrical conductor 260 that compresses to maintain electrical continuity along the length of the detonation module 110. The conductor 260 has a central opening that provides fluid communication between the detonator 206 and the booster 208 so that ballistic energy from the detonator 206 can propagate to the booster 208. The detonator housing 202 can have a holder 262 at the discharge end 209 thereof to hold a ballistic transfer member (not shown) in proximity with the booster 208 to carry ballistic energy down the perforation tool 100 to the charges 112. The loading tube 120 has a window 264 located near the discharge end 209 of the detonation module 110, when the detonation module 110 is installed in the loading tube 120. The window 264 is an opening that allows installation of the booster 208 from outside the loading tube 120, through the wall thereof, into the installed detonation module 110. The window 264 also allows arranging the ballistic transfer member with respect to the detonation module 110 before or after installation of the booster 208. An optional cutout 266 is formed in an edge of the window 264 to hold a wire, or the ballistic transfer member, in an advantageous position for optimal function of the perforation tool 100. For example, the cutout 266 can be used as a wire holder to prevent any damage to wiring within the perforation tool 100.

Figure 3:
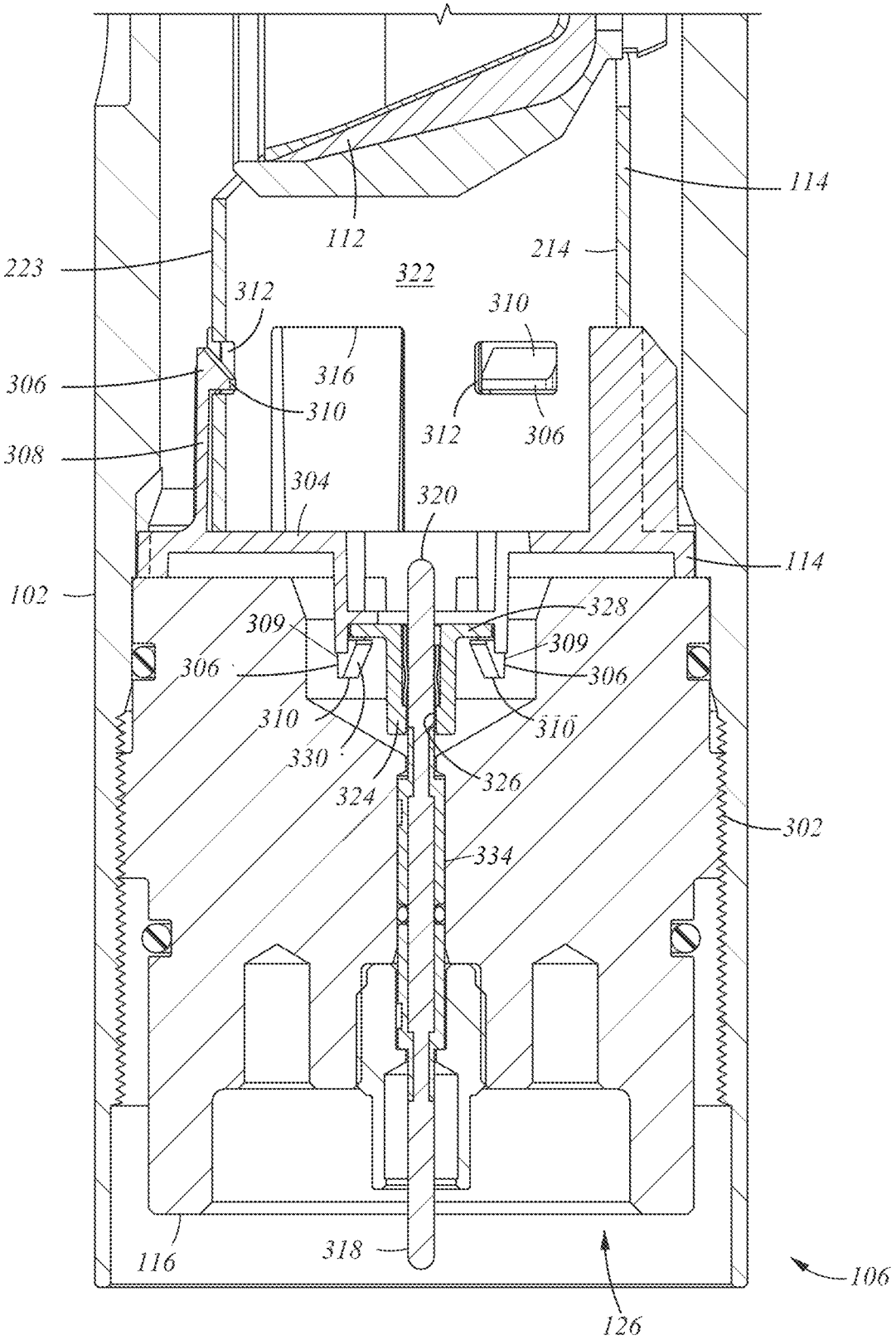
FIG. 3 is a detailed cross-sectional view of another portion of the perforation tool of FIG. 1.

FIG. 3 is a schematic cross-sectional view of the bulkhead end 106 of the perforation tool 100. The bulkhead module 126, comprising the bulkhead member 116 and the bulkhead coupler 114 is attached to the housing 102 by a threaded connection 302 of the bulkhead member 116. The bulkhead coupler 114 couples the bulkhead member 116 to the loading tube 120. The bulkhead coupler 114 is, in this case, a plastic component that has a transverse part 304 and a plurality of flexible projections 306 that extend in an axial direction of the perforation tool 100. A plurality of first projections 308, of the plurality of projections 306, extends in the axial direction toward the detonator end (not shown) of the tool 100 and a plurality of second projections 309, of the plurality of projections 306, extends in the axial direction toward the bulkhead end 106. The first projections 308 extend along the outer surface 223 of the loading tube 120 and engage with the loading tube 120, along the outer surface 223, to removably attach the bulkhead coupler 114 to the loading tube 120. The first projections 308 can have catches 310, like the catches 234, to engage with openings 312 in the loading tube 120 to removably attach the bulkhead coupler 114 to the loading tube 120. Here, the catches 310 face radially inward to attach the bulkhead coupler 114 to the loading tube 120 at the outer surface 223, whereas the catches 234 of the projections 232 face radially outward to attach the detonation module 110 to the loading tube at the inner surface 214. In this case, the bulkhead coupler 114 has three of the first projections 308, two of which are visible in FIG. 3, positioned at uniform azimuthal positions around the outside of the loading tube 120. Any reasonable number of projections 308 can be used. The first projections 308 generally flex outward as the loading tube 120 is inserted into, and engaged with, the bulkhead coupler 114 until the catches 310 reach the openings 312 and snap into the openings 312 to attach the bulkhead coupler 114 and the loading tube 120. Like the projections 232 of the detonator housing 202, the first projections 308 provide frictional engagement with the loading tube 120 to simplify insertion and retention.

The bulkhead coupler 114 also has an outer wall 314 in segments located between the first projections 308. The segments of the outer wall 314 are received by slots 316 formed in the second end 124 of the loading tube 120.

The bulkhead member 116 generally abuts the transverse portion 304 when the bulkhead member 116 is inserted into the bulkhead end 106 of the perforation tool 100. The bulkhead member 116 has an electrical feedthrough 318 disposed along a central axis thereof in an axial passage that extends from end to end of the bulkhead member 116. The electrical feedthrough 318 thus projects outward in an axial direction at both ends of the bulkhead member 116 to facilitate electrical connection to other components. A first end 320 of the electrical feedthrough 318 projects toward the bulkhead coupler 114, when the bulkhead member 116 is installed in the perforation tool 100, and into a central opening 322 of the bulkhead coupler 114.

The bulkhead coupler 114 has an electrical connector 324 for making electrical connection with the electrical feedthrough 318 of the bulkhead member 116. In some cases, the electrical connector 324 has a primary function of grounding for the perforation tool 100. The electrical connector 324 is a cylindrical member, in this case, with a central passage 326 for receiving the electrical feedthrough 318 and a flange 328 for securing the electrical connector 324 on the bulkhead coupler 114. The plurality of second projections 309 have catches 330 that engage with the flange 328 to hold the electrical connector 324 securely in a central recess 332 of the bulkhead coupler. An insert 334, such as barrel contact, can be disposed within the central passage 326 to facilitate secure electrical connection between the electrical connector 324 and the electrical feedthrough 318, if desired.

Figure 4:
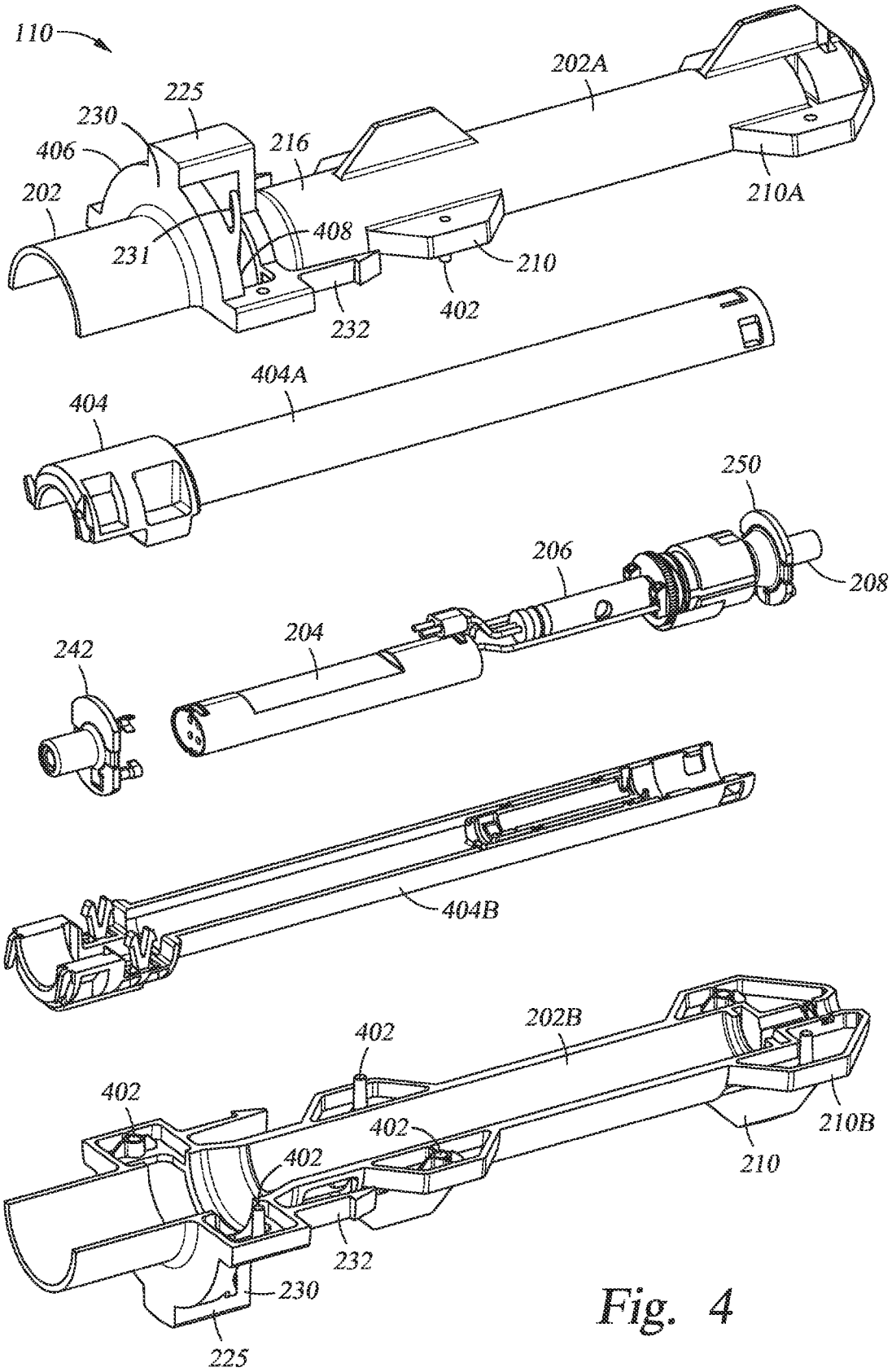
FIG. 4 is an exploded view of a detonation module usable with the perforation tool of FIG. 1.

FIG. 4 is an exploded view of the detonation module 110 used in the perforation tool 100 of FIG. 1. The detonator housing 202 is, in this case, in two pieces 202A and 202B which fit together to form the housing 202. The two pieces 202A and 202B come apart, and fit together, at the standoffs 210, such that each piece 202A and 202B has standoff pieces 210A and 210B. Each standoff piece 210A, 210B has a coupling 402 that engages with a corresponding coupling 402 on the opposite standoff piece 210A, 210B. The couplings 402 are posts and recesses in this case, with each post having a corresponding recess to engage with such that the standoff pieces 210A, 210B fit together securely to form the detonator housing 202. Using a detonator housing 202 that comes apart in two pieces 202A and 202B facilitates installing the internal components of the detonation module 110. The two plastic pieces 202A and 202B can be molded or 3D printed.

Here, the detonation module 110 has an inner housing 404 that houses the activator 204, detonator 206, and connector 242, and receives the receptacle 250 and booster 208 inserted into the receptacle 250. The inner housing 404 is also plastic, in this case, and also comes apart in two pieces 404A and 404B to facilitate assembly of the internal components of the detonation module 110. Using an inner housing 404, with the housing 202, allows the same inner components, housed in the same inner housing 404, to be used with different sized loading tubes, if desired. Detonator housings 202 of different sizes, for different sized loading tubes 120, can be used with the same internal components housed in the inner housing 404 to provide modular convenience.

In the view of FIG. 4, it can be seen that the detonator housing 202 has two groups of the standoffs 212, each group having four of the standoffs 212, with the standoffs 212 of one group having identical axial positions along the tube portion 216 of the housing 202. It can also be seen that each of the pieces 202A and 202B has two of the projections 232, and that the projections 232 of the two pieces 202A and 202B are adjacent and abutting when the two pieces 202A and 202B are joined. In this case, because the standoff pieces 210A and 210B become effectively one standoff 210 when the two pieces 202A and 202B are joined, each group of the standoffs 210 has two thick standoffs 210, which divide into the standoff pieces 210A and 210B when the housing 202 is separated into the two pieces 202A and 202B, and two thin standoffs 210 located at 90 degree angular displacements from the two thick standoffs 210. The standoffs 210 and projections 232 can be arranged in any suitable and convenient way. For example, each group of the standoffs 210 could have three standoffs 210, in uniform azimuthal distribution, or more than four standoffs 210, in uniform azimuthal distribution. There could be more than two groups of the first standoffs 210. There could also be just one group of the first standoffs 210. As mentioned above, the first standoffs 210 can also be provided in individual dispositions, not in groups. The projections 232 can likewise be arranged in any suitable and convenient manner.

The view of FIG. 4 also reveals that the centering structure formed by the second standoffs 225 features an intermediate rim 406. As with the groups of the first standoffs 210, there are four second standoffs 225, with the projections 232 extending from two of the second standoffs 225, which two second standoffs 225 are divided by separation of the housing 202 into the two pieces 202A and 202B. Couplings 402 are also included to join the standoffs 225 divided across the two pieces 202A and 202B. A first lateral part 230 of each standoff 225 extends from the intermediate rim 406, which itself extends radially outward from the tube portion 216, while a second lateral part 230 of each standoff 225, opposite from the first lateral part, extends directly from the tube portion 216 of the housing 202. In this case, the intermediate rim 406 extends to a radius that matches an inner radius of the flat portion 228 of each standoff 225, such that the first lateral part 230 of each standoff 225, such that at least a portion of the first lateral part 230 can be included in the intermediate rim 406. The fingers 231, in this case, extend in an axial direction from a transverse surface 408 of the intermediate rim 406, in addition to extending in radial and azimuthal directions. As shown in FIG. 4, the fingers 231 extend from the transverse surface 408 and abut the lateral part 230 of the standoffs 225 that extend directly from the tube portion 216 of the housing 202. In some cases, the fingers 231 can be configured to extend a distance sufficient to contact the inner surface 229 of the housing 102 to provide additional cushioning. As noted above, the shape, material, and configuration of the fingers 231 augments the cushion function of the cushion structure of the housing 202.

Figure 5A:
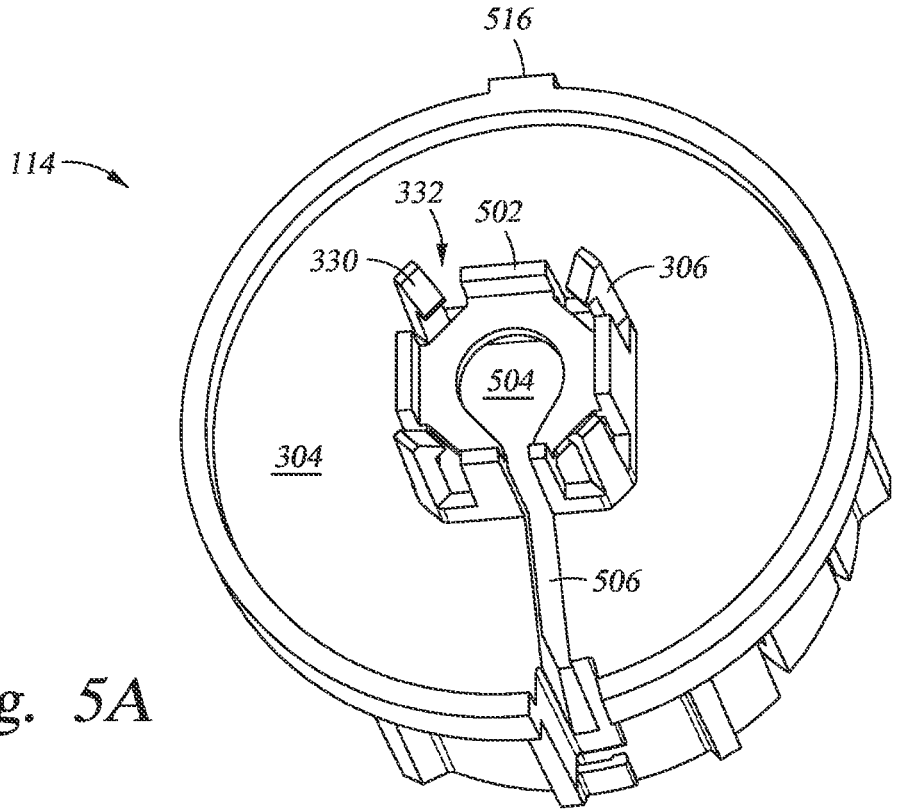
FIGS. 5A and 5B are perspective views of a bulkhead coupler usable with the perforation tool of FIG. 1.
Figure 5B:
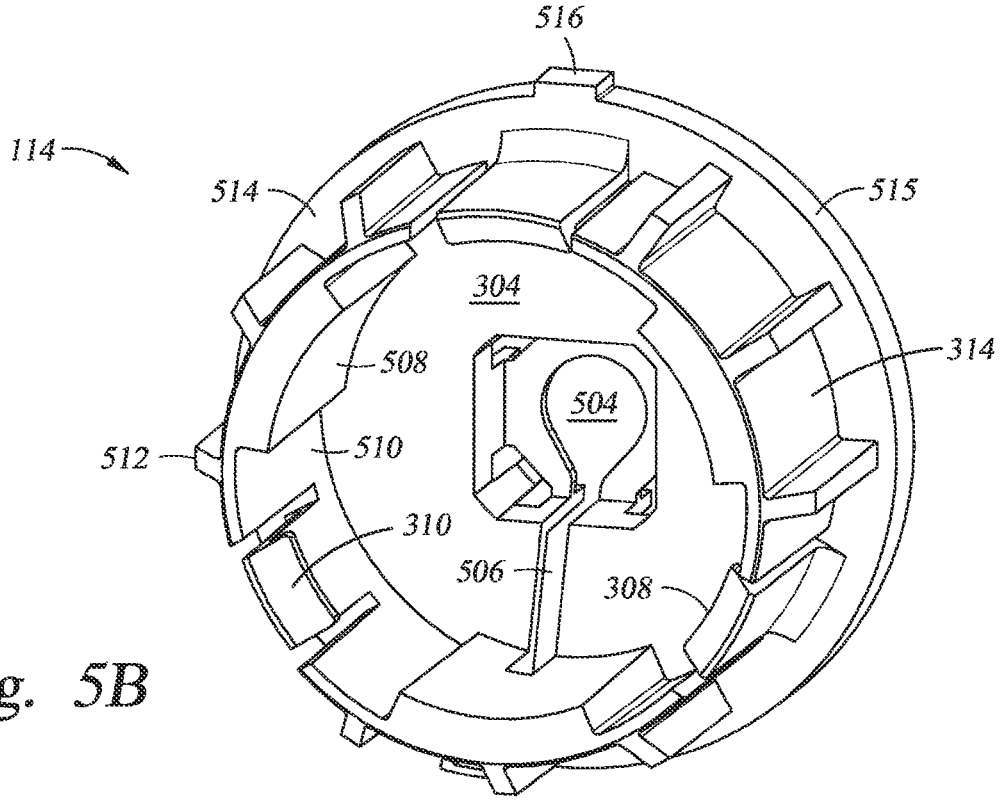

FIGS. 5A and 5B are perspective views of the bulkhead coupler 114 from front and rear vantage points. As can be seen in FIG. 5A, there are four of the projections 306 for engaging with the connector 324 (FIG. 3) arranged, in this case, at the corners of a square. The recess 332 has four walls 502, arranged at the periphery of the recess 332 between the projections 306. The recess 332 and projections 306 are thus configured such that the flange 328 (FIG. 3) of the connector 324 can have a corner-trimmed square shape. The flange 328 could also have a circular shape, with appropriate sizing of the projections 306 and catches 330.

As noted above, the bulkhead coupler 114 has a central opening 504 for receiving the end 320 of the electrical feedthrough 318 (FIG. 3). The transverse part 304 of the bulkhead coupler 114 has a perforation 506, extending from the central opening 504 to a segment of the outer wall 314 to allow feedthrough of electrical conductors such as wires. The arrangement of the segments of the outer wall 314 and the projections 306, with uniform azimuthal distribution in alternating positions, can be seen in FIG. 5B. Each outer wall segment 314 has a thickness selected to provide structural strength to the outer wall 314. Each outer wall segment 314 has a center portion 508 having a first thickness and an outer portion 510 having a second thickness less than the first thickness. Each outer wall segment 314 also has a plurality of ribs 512 extending radially outward from an outer radius 515 of the outer wall segment 314. The ribs 512 are thin in an azimuthal direction and have a radial dimension that extends to a location proximate to the inner surface 229 (FIG. 2) of the housing 102, when the charge module 108 (FIG. 1) is installed in the housing 102. The ribs 512 have an axial dimension selected to provide structural strength to the wall segments 314, which extends from the transverse part 304, along the wall segment 314 in the axial direction, to the edge of the wall segment 314.

The transverse part 304, in this case, has a continuous rim 514 extending circumferentially around the transverse part 304. The rim 514 has an outer radius that is larger than the outer radius of the outer wall 314, so the rim 514 extends radially outward beyond the outer wall 314 and abuts the inner surface 229 (FIG. 2) of the housing 102 when the charge module 108 (FIG. 1) is installed in the housing 102. The rim 514 thus allows the charge module 108 to be inserted into the housing 102 until the rim 514 abuts the inner surface 229. The bulkhead member 116 can then be installed at the bulkhead end 106 of the perforation tool. The bulkhead coupler 114 has an orientation feature 516 that projects radially outward from the rim 514 to engage with an orientation groove formed in the housing 102 along the internal surface 229. The orientation feature 516 is an azimuthal alignment feature, so that when the charge module 108 is assembled and inserted into the housing 102, the orientation feature of the bulkhead coupler 114 rotationally orients the charge module 108 so that the charges 112 are aligned and engaged with the openings 118 formed in the housing 102 (see FIG. 1). Thus, the bulkhead coupler 114 serves to secure and orient the charge module 108 within the housing 102.

Figure 6:
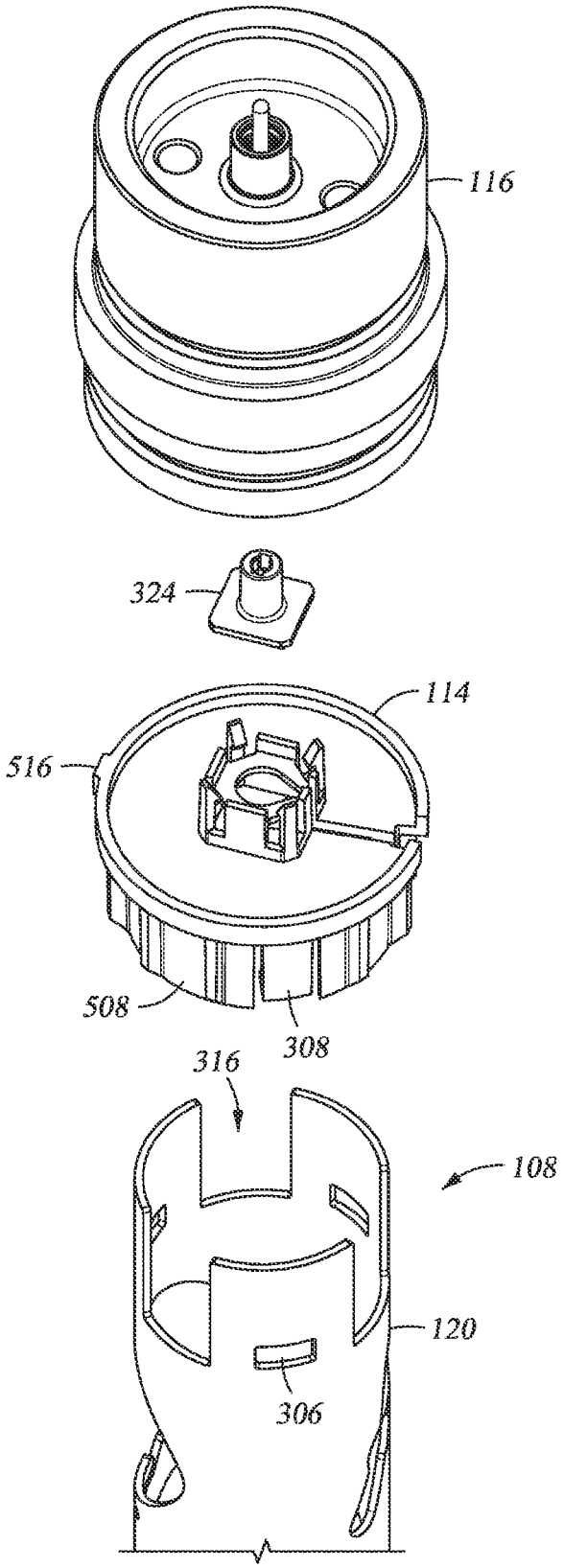
FIG. 6 is an exploded view of a portion of the perforation tool of FIG. 1.

FIG. 6 is an exploded view of the charge module 108 at the bulkhead end 106 of the perforation tool 100. This view illustrates how the bulkhead coupler 114 engages with the loading tube 120 such that the thick portions of the outer wall 314 of the bulkhead coupler engage with the slots 316 of the loading tube 120 and the catches 310 of the projections 308 engage with the openings 312 of the loading tube 120. FIG. 6 also shows an embodiment of the connector 324 having a corner-trimmed square flange.

As illustrated in FIGS. 3, 5, and 6, the orientation feature 516 functions to orient the charge module 108 within the housing 102. By securing the loading tube using the bulkhead coupler at the bulkhead end, the detonator end (e.g., an upper end) of the perforating tool is configured to be opened to position the detonation module for installation. In certain embodiments, the detonation module may simply be dropped into the detonator end end of the perforation tool for installation. That is, the detonation module may be installed in the perforation tool without substantial configuration. In this way, the charge module 108 provides both electric and ballistic arming in a single assembly step, so the perforating tool may be easily armed in the field.

Additionally, installation of the detonation module at the detonator end of the perforation tool provides some distance between the closest charge within the perforation tool and the bulkhead member. This distance helps prevent damage to the bulkhead member, electrical components of the perforation tool and/or detonation module, and the perforation tool itself that might otherwise be caused by the firing of an adjacent perforation tool.

Further, the materials of construction of the detonator housing, the bulkhead coupler, and the loading tube are low-cost components of the perforation tool that provide several functions. First, the detonator housing centralizes the loading tube in the tool housing. Second, the detonator housing houses the electrical connector associated with the detonation module. For instance, the connector may be an RCA style connector. Third, the detonator housing aligns and houses the detonation module in the perforating tool, thereby guiding the detonation module into the connector. Fourth, the detonator housing secures the ballistic transfer member, which may be a detonating cord, and a booster in place and in-line with the detonation module. Fifth, the detonator housing includes small standoffs that contact the loading tube. The standoffs are flexible or bendable, thereby providing a shock absorbing spring function for detonation shocks caused by the firing of adjacent perforation tools. The detonator housing therefore floats axially in the loading tube to allow for shock absorption. The standoffs also keep the loading tube in compression when an adjacent perforation tool is connected to the perforation tool. The compression helps keep the electrical connections engaged at each end of the perforation tool during shock events.

The bulkhead coupling of the perforation tool also provides several functions. First, the bulkhead coupling keys the loading tube to the gun carrier housing to keep the loading tube and gun carrier housing in a desired orientation. Second, the bulkhead coupling has a wire clip that keeps the wire in position. Third, the bulkhead coupling has a clip on the end that secures the wire connector in place and aligned with the bulkhead electrical feedthrough. Fourth, the bulkhead coupling centralizes the loading tube in the gun carrier.

The preceding description has been presented with reference to present embodiments. Persons skilled in the art and technology to which this disclosure pertains will appreciate that alterations and changes in the described structures and methods of operation can be practiced without meaningfully departing from the principle, and scope of this present disclosure. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A perforation tool, comprising:

a loading tube for supporting a plurality of perforation charges, the loading tube having a first end and a second end;

a detonation module disposed within the loading tube at the first end thereof, the detonation module comprising a plastic detonator housing for enclosing a detonation component, the detonation component comprising an activator positioned along an axis of the detonator housing and a booster located at a discharge end of the detonator housing, the booster coupled to the activator to receive an energy stimulus from the activator, the detonator housing having a plurality of first flexible projections that extend in an axial direction of the detonator housing and engage with the loading tube, along an interior surface thereof, to removably attach the detonation module to the first end of the loading tube, the detonator housing having a centering structure for centering the loading tube, at the first end thereof, within the perforation tool; and a bulkhead module coupled to the second end of the loading tube, the bulkhead module comprising a bulkhead member and a bulkhead coupler, the bulkhead coupler comprising an electrical connector for making electrical connection with the bulkhead member and a plurality of second flexible projections that extend in an axial direction of the perforation tool and engage with the loading tube, along an outer surface thereof, to removably attach the bulkhead coupler to the loading tube, the bulkhead coupler configured to center the loading tube, at the second end thereof, within the perforation tool.

2. The perforation tool of claim 1, wherein the loading tube has a cutout adjacent to the discharge end of the detonator housing, the cutout having a size sufficient to install a detonator in the detonation module when the detonation module is disposed within the loading tube.

3. The perforation tool of claim 1, wherein the first flexible projections are first tabs and the second flexible projections are second tabs.

4. The perforation tool of claim 3, wherein the first tabs have catches that face radially outward for engaging with openings of the loading tube, and the second tabs have catches that face radially inward for engaging with openings of the loading tube.

5. The perforation tool of claim 1, wherein the detonator housing comprises two molded plastic members, each member having a portion of the first flexible projections.

6. The perforation tool of claim 1, wherein the first flexible projections extend from the centering structure.

7. The perforation tool of claim 1, wherein the bulkhead coupler has an orientation feature.

8. The perforation tool of claim 1, wherein the bulkhead coupler has a plurality of projections that have catches facing radially inward to couple to the electrical connector.

9. The perforation tool of claim 1, wherein the bulkhead coupler has a transverse portion from which the second flexible projections extend, the transverse portion has an orientation feature, and the transverse portion has a plurality of axial extensions that couple a loading tube coupling member to the electrical connector.

10. The perforation tool of claim 1, wherein the activator comprises a detonator, the booster and the detonator are ballistically coupled by a compressible electrical conductor having an opening for transmitting ballistic energy from the detonator to the booster.

11. The perforation tool of claim 1, wherein the electrical connector is a first electrical connector, the detonator housing has a stimulus end, opposite from the discharge end, and the stimulus end houses a second electrical connector in a capture recess.

12. A perforation tool, comprising:

a loading tube for supporting a plurality of perforation charges, the loading tube having a first end and a second end;

a detonation module disposed within the loading tube at the first end thereof, the detonation module comprising a plastic detonator housing for enclosing a detonation component, the detonation component comprising an activator positioned along an axis of the detonator housing and a booster located at a discharge end of the detonator housing, the booster coupled to the activator to receive an energy stimulus from the activator, the detonator housing having a plurality of first flexible projections that extend in an axial direction of the detonator housing and engage with the loading tube, along an interior surface thereof, to removably attach the detonation module to the first end of the loading tube, the detonator housing having a centering structure for centering the loading tube, at the first end thereof, within the perforation tool and a cushion structure within the centering structure; and a bulkhead module coupled to the second end of the loading tube, the bulkhead module comprising a bulkhead member and a bulkhead coupler, the bulkhead coupler comprising an electrical connector for making electrical connection with the bulkhead member and a plurality of second flexible projections that extend in an axial direction of the perforation tool and engage with the loading tube, along an outer surface thereof, to removably attach the bulkhead coupler to the loading tube, the bulkhead coupler configured to center the loading tube, at the second end thereof, within the perforation tool.

13. The perforation tool of claim 12, wherein the cushion structure comprises a plurality of fingers, each of which is elongated in a direction transverse to the axial direction of the perforation tool.

14. A perforation tool, comprising:

a loading tube for supporting a plurality of perforation charges, the loading tube having a first end and a second end;

a detonation module disposed within the loading tube at the first end thereof, the detonation module comprising a plastic detonator housing for enclosing a detonation component, the detonation component comprising an activator positioned along an axis of the detonator housing and a booster located at a discharge end of the detonator housing, the booster coupled to the activator to receive an energy stimulus from the activator, the detonator housing having a plurality of first flexible projections that extend in an axial direction of the detonator housing and engage with the loading tube, along an interior surface thereof, to removably attach the detonation module to the first end of the loading tube, the detonator housing having a first centering structure for centering the loading tube, at the first end thereof, within the perforation tool and a cushion structure within the first centering structure; and a bulkhead module coupled to the second end of the loading tube, the bulkhead module comprising a bulkhead member and a bulkhead coupler, the bulkhead coupler comprising an electrical connector for making electrical connection with the bulkhead member and a plurality of second flexible projections that extend in an axial direction of the perforation tool and engage with the loading tube, along an outer surface thereof, to removably attach the bulkhead coupler to the loading tube, the bulkhead coupler configured to center the loading tube, at the second end thereof, within the perforation tool, wherein the detonator housing further comprises a second centering structure for centering the detonator housing within the loading tube.

15. The perforation tool of claim 14, wherein the first centering structure comprises a plurality of first standoffs arranged with angular spacing of 90 degrees and the second centering structure comprises a plurality of second standoffs arranged with angular spacing of 90 degrees.

* * * * *